US007137434B1

(12) United States Patent
Savariego

(10) Patent No.: US 7,137,434 B1
(45) Date of Patent: Nov. 21, 2006

(54) CONTINUOUS ROLL CASTING OF FERROUS AND NON-FERROUS METALS

(76) Inventor: Samuel F. Savariego, 5905 Forest Glenn Blvd., Dallas, TX (US) 75230

( * ) Notice: Subject to any disclaimer, the term of this patent is extended or adjusted under 35 U.S.C. 154(b) by 0 days.

(21) Appl. No.: 11/036,253

(22) Filed: Jan. 14, 2005

Related U.S. Application Data

(60) Provisional application No. 60/536,383, filed on Jan. 14, 2004.

(51) Int. Cl.
*B22D 11/12* (2006.01)

(52) U.S. Cl. ..... 164/155.4; 164/154.4; 164/417

(58) Field of Classification Search ..... 164/155.4, 164/154.4, 154.5, 154.7, 417
See application file for complete search history.

(56) References Cited

U.S. PATENT DOCUMENTS 3,817,317 A 6/1974 Gilmore
4,054,173 A 10/1977 Hickam
4,497,360 A 2/1985 Bercovici
4,561,488 A 12/1985 Niyama et al.
5,303,765 A 4/1994 Pearson et al.
5,400,850 A * 3/1995 Flemming et al. ..... 184/417
5,518,064 A 5/1996 Romanowski et al.
5,584,336 A 12/1996 Romanowski et al.
6,044,895 A * 4/2000 Kuttner et al. ..... 164/155.4
6,092,586 A * 7/2000 Schonbeck ..... 164/476
6,241,002 B1 6/2001 Russell et al.
6,474,403 B1 11/2002 Nikolovski et al.

* cited by examiner

*Primary Examiner*—Len Tran
(74) *Attorney, Agent, or Firm*—Stephen T. Belsheim

(57) ABSTRACT

A method of continuously casting metal strip, as well as an apparatus for carrying out the process, wherein the process includes the steps of: providing a pair of casting rolls operating at a selected rotational speed and the two casting rolls being spaced apart from each other at a pre-selected distance; introducing molten metal between the two casting rolls; monitoring the separation force exerted on the two casting rolls by the molten metal, and adjusting the rotational speed of the two casting rolls in response to the magnitude of the separation force wherein the rotational speed of the two rolls is reduced when the separation force is below a lower value and the rotational speed of the two rolls is increased when the separation force is above an upper value; and processing the strip by removing any shape defects therein.

6 Claims, 12 Drawing Sheets

CONTINUOUS ROLL CASTING OF FERROUS AND NON-FERROUS METALS

CROSS-REFERENCE TO EARLIER FILED PROVISIONAL PATENT APPLICATION

Applicant hereby claims the benefit of the earlier filed pending U.S. Provisional Patent Application No. 60/536,383 filed by Samuel F. Savariego on Jan. 14, 2004 for CONTINUOUS ROLL CASTING OF FERROUS AND NON-FERROUS METALS.

BACKGROUND

This invention is related to metal working machinery and processes, and more particularly, to improvements in an apparatus for the, as well as the process of, continuous roll casting of ferrous and non-ferrous metals. In this regard, Sir Henry Bessemer first conceived the concept of continuous roll metal casting in the year 1853. Since then there have been a number of developments in continuous roll metal casting technology.

One such area of development pertains to a hot rolling casting process. In the hot rolling casting process, molten metal is fed into the bite between a pair of counter-rotating cooled rolls wherein solidification is initiated when the metal contacts the rolls. Solidification prior to the roll nip, or point of minimum clearance between the rolls, causes the metal to be deformed, or hot rolled, prior to exiting the rolls as a solidified sheet.

While the hot rolling casting process has provided a number of benefits, there remains a desire to improve upon such a process in a number of ways. One such area of improvement concerns the number of steps that have been necessary to produce a steel coil using the hot rolling casting method. Heretofore, the typical hot rolling process comprised the steps of: (1) casting of the molten metal, (2) hot rolling the cast material into sheet, (3) pickling the hot rolled sheet so as to remove surface skin, (4) cold rolling the pickled sheet, (5) cleaning the cold rolled sheet, (6) annealing the cleaned cold rolled sheet and, (7) remove shape defects of the rolled sheet. As can be appreciated, each process step adds an expense to the overall cost of production. Hence, it would be highly desirable to provide an improved apparatus and process for the continuous roll casting of metals that would not need as many steps as heretofore required with known twin roll casting process. More specifically, it would be highly desirable to provide such an improved apparatus and process that eliminates the steps of cold rolling, cleaning and annealing.

Another area of improvement concerns the ability to produce a cast metal strip that exits the casting rolls wherein the cast metal strip exhibits a consistent and predetermined thickness. It would thus be highly desirable to provide an improved apparatus and process for the continuous roll casting of metals that would produce a cast metal strip exiting the casting rolls that exhibits a consistent and predetermined thickness.

In the hot rolling casting process it is important to provide an apparatus, as well as a process, that results in the least number of (or essentially completely eliminates the) physical defects in the hot rolled strip. After the hot rolled strip has been pickled and the skin removed and the skin passed so as to provide a cold rolled-like finish, the roll is being wound around a precision mandrel and simultaneously submitted to reversed bends as to elongate 80% of the grain of the steel. The Precision (deflection free) mandrel then detects the part of the strip with shorter grains and elongate the shorter grain portion of the strip so that all grains are of equal lengths. During the winding process, the metal strip is subjected to high tension as well as being simultaneously subjected to reverse bends. Any defects in the strip while being subjected to this process can result in certain undesirable conditions. Thus, it would be highly desirable to provide an improved apparatus and process for the continuous roll casting of metals that would produce a metal strip that exhibits a consistent thickness and shape.

For example, if there is any non-uniformity in the strip thickness or unequal length in the grains of the strip as the material is being subjected to reverse bending to a predetermined amount and then wound around the mandrel, tension forces are exerted on the strip. If the magnitude of the tension forces on the strip exceeds the yield strength of the material of the strip as it is being subjected to the reverse bends, then the shorter grains of the strip will elongate to the same length as all the other grains, and this will result in a strip that is free of defects. It can thus be appreciated that it would be highly desirable to provide an improved apparatus and process for the continuous roll casting of metals that would monitor and control the elongation of the strip so that the entire cross section of the strip is elongated by a given preset amount thereby eliminating all shape defects wherein the strip does not exhibit defective conditions.

Another example of defects heretofore found in strip steel is edge waves. More specifically, this edge wave condition is caused because the grains on the edges of the strip are longer (or thinner) than the grains on the center of the strip so that the grains in the center of the strip are thicker. As the material is wound about the precision drum and simultaneously being subjected to reverse bends so that the built-up of the layers causes the tension on the thicker part of the strip (i.e., the center of the strip) to be higher than the tension on the thinner part of the strip (i.e., the edge portions).

Keeping in mind that the tension is assisted by the reverse bending rolls, as the winding process continues the tension on the thicker strip becomes greater than what the entire cross section of the strip can withstand so that the thicker part of the cross section elongates the short grains, as it tries to travel at a higher peripheral speed than the thinner part, is first elongated and then the elongation extends toward the edges of the strip until the total cross section of the strip is elongated and monitored to insure that all grains are of equal length. It can thus be appreciated that it would be highly desirable to provide an improved apparatus and process for the continuous roll casting of metals that would monitor and control the elongation of the strip so as to essentially eliminate the condition of edge waves.

As still another example of defects heretofore found in steel strip there is the condition known as center buckle or oil can or cross bow. These defects are caused because the grains on the middle part of the strip are longer (thinner) than the grains on the edges of the strip (thicker). As the material is subjected to reverse bends so that 80% of the cross section of the grains are elongated and then wound about the precision drum, the shorter grains are subjected to higher tension and are elongated so that all grains are of equal length.

Keeping in mind the assistance provided by the reverse bending rolls, the tension on the strip is greater than what the entire cross section of the strip can withstand, the thicker part of the cross section, as it tries to travel at a higher peripheral speed than the thinner part, is first elongated and then the elongation extends, beginning at the edges of the strip and then moving toward the center of the strip, until the total cross section of the strip is elongated. It can thus be appreciated that it would be highly desirable to provide an improved apparatus and process for the continuous roll casting of metals that would monitor and control the elongation of the strip so as to essentially eliminate the condition of center buckle or oil can or cross bow.

As yet another example of defects heretofore known in steel strip is the condition known as camber. The condition of camber is caused because the grains of one edge of the strip is longer (thinner) than the grains of the opposite edge of the strip. The edge of the strip where the grains are shorter (thicker), as the material is wound about the precision drum, the built-up of the layers causes the tension on the side of the shorter grains of the strip to be higher than the tension on the longer edge of the strip.

Keeping in mind the assistance provided by the reverse bending rolls, the shorter (thicker) edge of the strip is elongated first. Then the elongation of the strip, progressively move from the thicker to the thinner edge of the strip until the entire cross section of the strip is elongated a predetermined amount. It can thus be appreciated that it would be highly desirable to provide an improved apparatus and process for the continuous roll casting of metals that would monitor and control the elongation of the strip so as to essentially eliminate the condition of camber.

SUMMARY

In one form thereof, the invention is a method of continuously casting metal strip comprising the steps of: providing a pair of rotating sleeves which are internally water cooled via a stationary chamber operating at a selected rotational speed and the two casting rolls being spaced apart from each other at a pre-selected distance; introducing molten metal between the two casting rolls: monitoring the separation force exerted on the two casting rolls by the molten metal, and adjusting the rotational speed of the two casting rotating sleeves in response to the magnitude of the separation force wherein the rotational speed of the two rolls is reduced when the separation force is below a lower value and the rotational speed of the two rolls is increased when the separation force is above an upper value.

In another form thereof, the invention is a method of continuously treating a moving metal strip, the method comprising the steps of: providing a mandrel driven by a motor for receiving the metal strip; providing a reverse bending roll station that engages the metal strip upstream of the mandrel; providing and equalizer roll assembly upstream of the reverse bending roll station; providing an upstream strip speed monitor located upstream of the reverse bending roll station and downstream of the equalizer roll assembly whereby the upstream strip speed monitor monitors the speed of the strip as it enters the reverse bending station; providing a downstream strip speed monitor located downstream of the reverse bend station whereby the downstream strip speed monitor monitors the speed of the strip as it exits the reverse bending station; and controlling the tension exerted on the metal strip by the equalizer roll assembly as a function of the difference between the speed of the strip entering the reverse bending station and the speed of the strip exiting the reverse bending station.

In yet another form thereof, the invention is an apparatus for continuously treating a moving metal strip. The apparatus includes a mandrel driven by a motor whereby the mandrel receives the metal strip in a coil. There is a reverse bending roll station positioned upstream of the mandrel whereby the reverse bending station engages the metal strip. The apparatus includes an equalizer roll assembly located upstream of the reverse bending roll station. There is an upstream strip speed monitor located upstream of the reverse bending roll station and downstream of the equalizer roll assembly so as to monitor the speed of the strip as it enters the reverse bending station, and a downstream strip speed monitor located downstream of the reverse bend station so as to monitor the speed of the strip as it exits the reverse bending station. The apparatus further includes a controller operatively connected to the equalizer roll assembly so as to control the tension exerted on the strip by the equalizer roll assembly as a function of the difference between the speed of the strip entering the reverse bending station and the speed of the strip exiting the reverse bending station.

BRIEF DESCRIPTION OF THE DRAWINGS

The following is a brief description of the drawings that form a part of this patent application.

DETAILED DESCRIPTION

Figure 1:
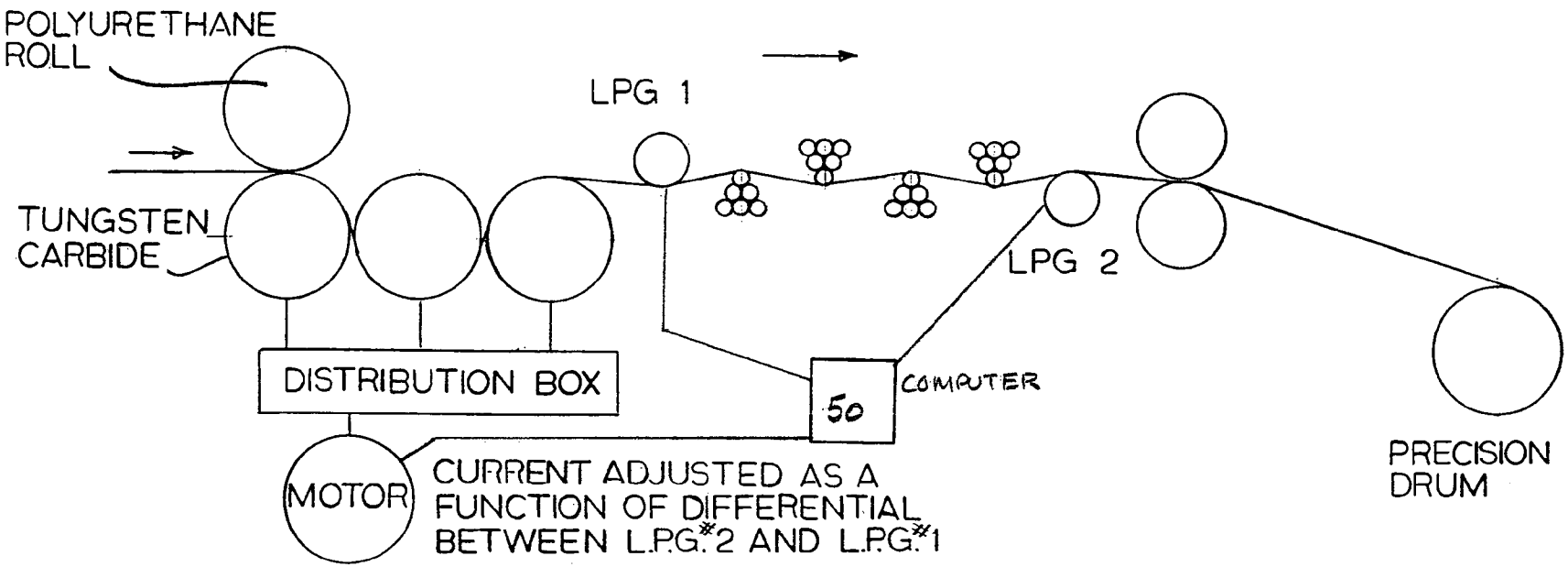
FIG. 1 is a mechanical schematic view of the portion of the process apparatus utilized to correct physical defects in the steel strip.

Referring to the drawings, this invention provides an improved apparatus, as well as an improved process, for the continuous roll casting of ferrous and non-ferrous metals. As will be described hereinafter, the present invention provides an improvement in the process of continuous roll metal casting by synchronizing of the solidification of the molten metal with the rotational speed of the casting rolls and the rate of cooling of the casting rolls. In other words, in order to improve the quality of the cast metal exiting the casting rolls in the casting station, one controls the rotational speed of the casting rolls and the temperature of the casting rolls via the rate of cooling of the casting rolls. This is achieved by monitoring the separation forces exerted on the casting rolls by the molten metal via precision load cells operatively connected to the casting rolls. The rotational speed and rate of cooling of the casting rolls and then controlled in response to the magnitude of the separation forces.

In this arrangement of the casting station, one casting roll is mounted in a fixed position and the other casting roll is movable on precision slides located at each end of the casting roll. Linear transducers are located under the slides. The linear transducers register the position of the movable casting roll in reference to the fixed casting roll. Initially the casting rolls are positioned so that the distance between the two casting rolls is equal to the desired strip thickness. A pre-established value for the required separation force is entered into the system computer. The load cells then provide the actual value of the separation forces exited on the casting rolls as the strip is cast. The value of the separation force is provided to the system computer so that if the separation force varies from the pre-selected value (or range), the computer controls the motors that drive the casting rolls so as to change (or vary) the rotational speed to maintain the separation force at the desired pre-established value (or range).

Still referring to the casting station, the two casting rolls are intensively and continuously cooled. The temperature of the incoming cooling water to each casting roll and the exiting cooling water from each casting roll is continuously monitored and those values fed into the system computer. The computer then controls the flow rate of cooling water to the casting rolls so that a calculated (or desired) temperature gradient between the incoming water and exiting water is maintained. If the temperature gradient is too low, then the flow rate of cooling water is trimmed down and if the temperature gradient is too high, then the flow rate of cooling water is trimmed up from the pre-established and calculated value.

After the strip has been cast, it is hot reduced by two hot strip mills which are located immediately in tandem. After the Hot Rolling Stand, an x-ray gauge monitors the output thickness of the second stand and via a closed loop controls, the required changes are executed in order to produce a high quality strip of the desired precise thickness and shape.

Another aspect of the invention is a device to correct all physical defects. In this specific embodiment, such a device to correct all physical defects is embodied in an equalizer station.

As hot rolled strip, which has been pickled and the skin passed to provide a cold rolled-like finish, is being wound around a precision mandrel, the strip is subjected to high tension as it is simultaneously subjected to reverse bends, if there is any non-uniformity on the strip thickness or unequal length in the grains of the strip, as the material is being would around the mandrel, if the tension value on the strip exceeds the yield strength of the strip as is being subjected to the reverse bends, then the shorter grains of the strip will elongate. By providing a device (i.e., the equalizer station which includes the mandrel described hereinafter) to monitor and control the elongation, then when the entire cross section of the strip is elongated by a given preset amount, all shape defects are eliminated. The shape correction device (i.e., the equalizer station) guarantees a camber free product.

Referring to the drawings and especially FIG. 5A through FIG. 7B, in one aspect, the invention is a method of continuously casting metal strip (as well as an apparatus for carrying out this process) by introducing molten metal between two casting rolls (24, 26) that comprise part of the casting station. The casting rolls (24, 26) are turning in opposite directions and the casting rolls are continuously and intensively cooled by circulating water. Two side plates are tightly fitted against the turning casting rolls (24, 26) in order to form a sort of mold that contains the molten metal.

One casting roll 26, i.e., the adjustable casting roll, is precisely adjusted in relation to the other casting roll 24 to a dimension (or distance) between the casting rolls (24, 26) that is equal to the desired thickness of the strip (30) to be cast. Load cells (34, 36) are mounted on each end and under the slide of the adjustable casting roll 26. These load cells (34, 36) monitor the separation forces between the two casting rolls (24, 26), i.e., the separation force exerted on the casting rolls (24, 26) by the molten metal.

If during the casting process the casting rolls (24,26) are turning (i.e., rotating) too fast, the load cells (34,36) will register a low separation force in that the separation force is below a pre-selected lower limit. A signal that indicates a too fast rotational speed (i.e., the casting rolls are rotating to fast) will be sent to the system computer (termed speed control in FIG. 7B) 50. The system computer 50 will then operate to reduce the speed of the motors that drive the casting rolls 24, 26. By reducing the rotational speed of the casting rolls, the separation force will be increased to an acceptable level.

If the casting rolls 24,26 are turning (i.e., rotating) too slow, then the load cells 34,36 will indicate a high separation force in that the separation force is above a pre-selected upper limit. A signal that indicates a too slow rotational speed (i.e., the casting rolls are rotating too slow) will be sent to the system computer 50. The system computer 50 will then operate to increase the speed of the motors that drive the casting rolls. By increasing the rotational speed of the casting rolls, the separation force will be decreased to an acceptable level.

As can be appreciated, the load variations are continuously monitored by the system computer. The magnitude of the separation force registered by the load cell results in the rotational speed of the casting rolls being either trimmed (or controlled or adjusted) up or down. By adjusting the rotational speed of the casting rolls, the magnitude of the separation force is maintained within a pre-selected range of values.

Figure 6A:
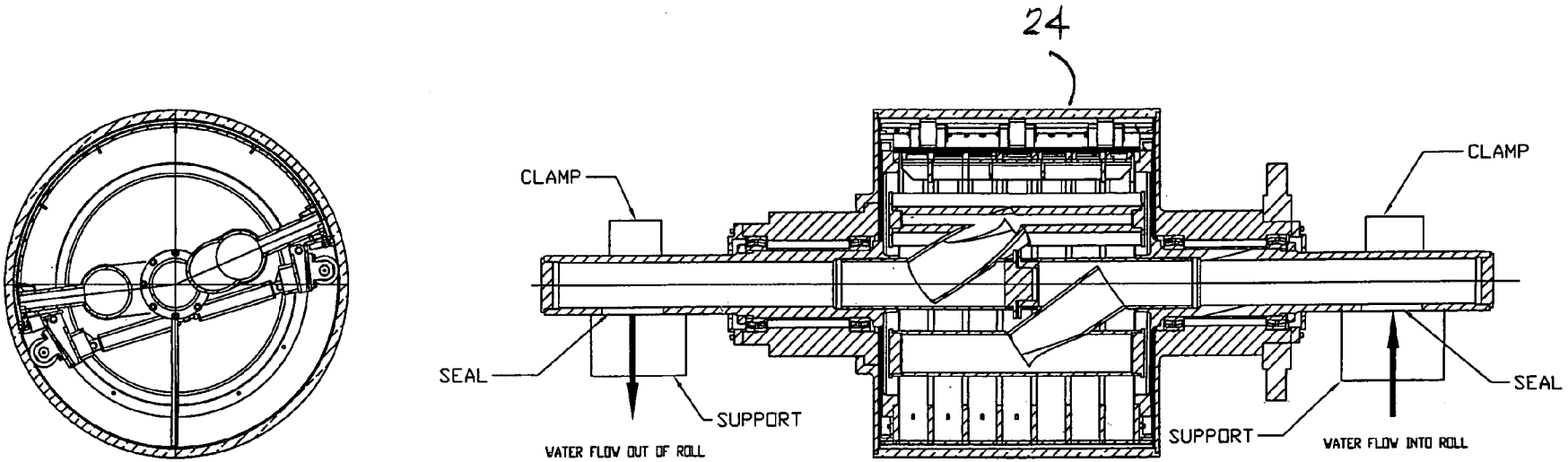
FIG. 6A is a cross-sectional view of one casting roll in the casting station illustrating the entrance and exit of the cooling water into and out of the casting roll.
Figure 6B:
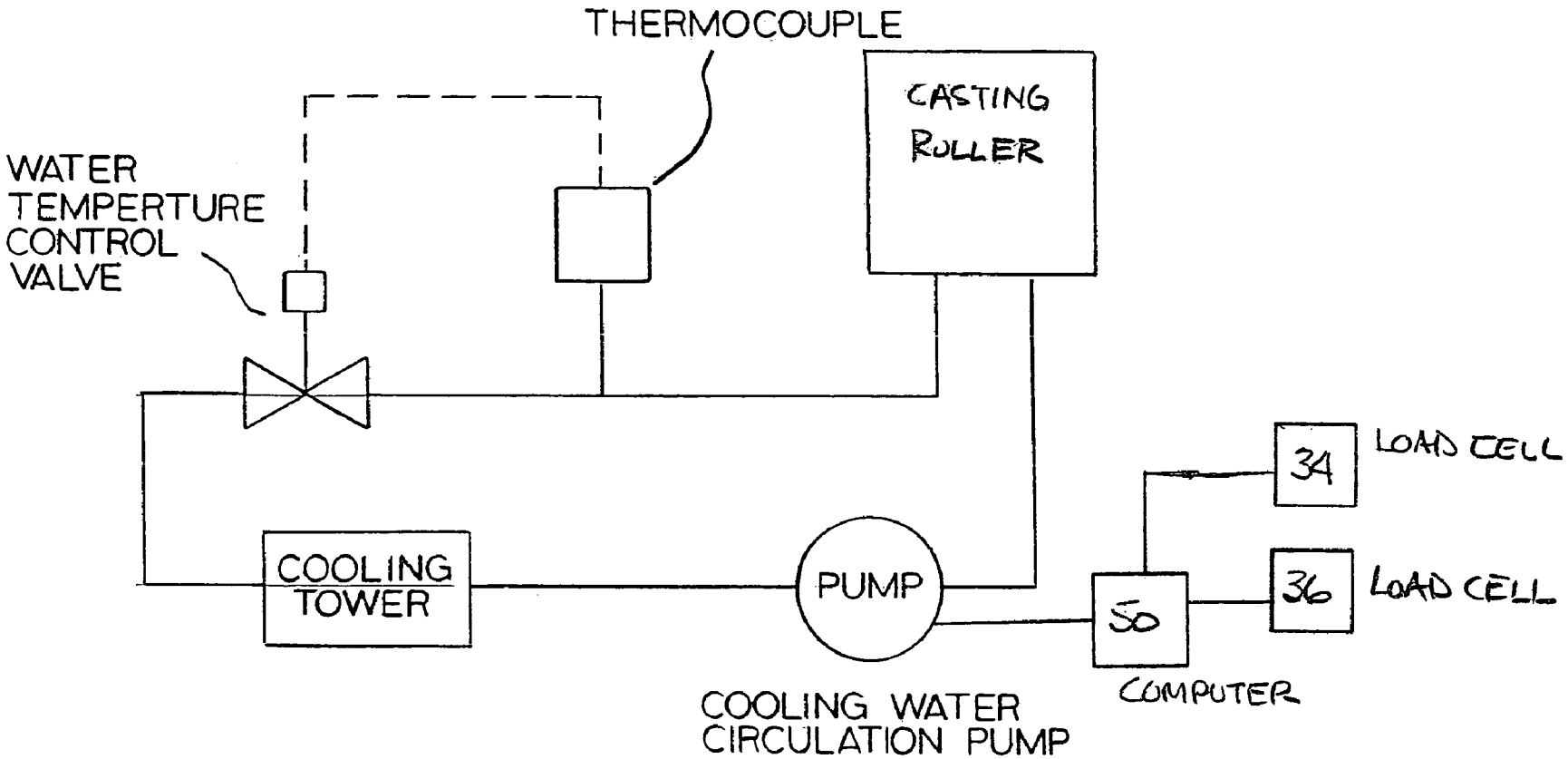
FIG. 6B is a schematic view illustrating the control arrangement for the supply of cooling water to the casting rolls in the casting station.

Referring especially to FIGS. 6A and 6B, the rate of flow of cooling water to the casting rolls (24, 26) is trimmed (or controlled or adjusted) as a function of the magnitude of the separation force exerted on the casting rolls by the cast metal registered by the load cells. The water temperature of the exiting water from the casting rolls is continuously monitored by the thermocouple. The difference between these water temperatures is the temperature gradient between the temperature of the water that enters and exits the casting rolls. This gradient is compared to the separation force of the two casting rolls. If the separation force as registered by the load cells tends to increase, or consequently if the separation force tends to decrease, then this information is fed into the system computer that controls the pump so that the flow rate is trimmed accordingly to match the calculated and empirical value for the separation force in the recipe menu of the system computer.

More specifically and as illustrated in the schematic FIG. 6B, if the load cells indicate that the separation force is too low, then a signal is sent to the computer (50) that controls the flow rate of cooling water to the casting rolls for increased cooling of the metal. More specifically, if the load cells indicate that the separation force is too high, then a signal is sent to the computer (50) that controls the flow rate of cooling water to the casting rolls for decreased cooling of the metal.

In looking at the overall process, the system computer will compare the empirical values on the recipe menu and will set the three variables referred to above, i.e., the rotational speed of the casting rolls, the temperature gradient of the cooling water supplied to the casting rolls, and the separation force, so that the rate of rotation of the casting rolls and the flow rate of the cooling water precisely match (or correlate to) the desired separation force between the two casting rolls.

No where in the process of this invention is the strip thickness measured as it is being cast. The precise positioning of the casting rolls (including the rotational speed of the casting rolls), the monitoring of the separation force, and the controlled flow of cooling water provides for an accurate as cast thickness of the strip. As can be appreciated, the various input data (e.g., separation force, casting roll rotational speed and cooling water temperature gradient) is fed into the system computer whereby the system computer controls the casting roll rotational speed and cooling water temperature gradient.

The system of this invention is differentiated from other steel systems that are available in the market produced by conventional processes that includes the following steps: (1) casting, (2) hot rolling, (3) pickling, (4) cold rolling, (5) cleaning and (6) annealing. The process of the invention skips (i.e., omits) steps (4), (5) and (6), and the process of the invention produces a precise metal strip with a cold rolled surface finish that is dead flat and camber free. At the same time, the process significantly reduces production cost of a product that is a substitute for cold rolled steel produced by conventional methods. Another great advantage of the process is that it saves energy.

The finishing process, exclusive to this system, subjects the pickled (oxide is removed) and skin passed (smooth cold rolled finished surface) metal strip to a process so as to equalize the grains in the strip (exclusive process). This step is performed at an equalizer station. By subjecting the metal strip to the grain equalization step, the process of the invention removes all possible shape defects from the strip, including camber. It should be appreciated that the camber defect is a defect that is ever present in all steels produced by other methods, except for the present process.

Referring to the drawings and especially FIG. 1, the shape correction device to correct all physical defects includes: a device to induce tension on the strip, and a device to subject the material to reverse bends, and a precision drum designed so that when the material is subjected to high tensions, the shaft supporting the drum does not deflect. As mentioned in the Background hereinabove, thin flat rolled steel commonly has some or all of the following physical shape defects that are discussed hereinafter.

Figures 2A, 2B:
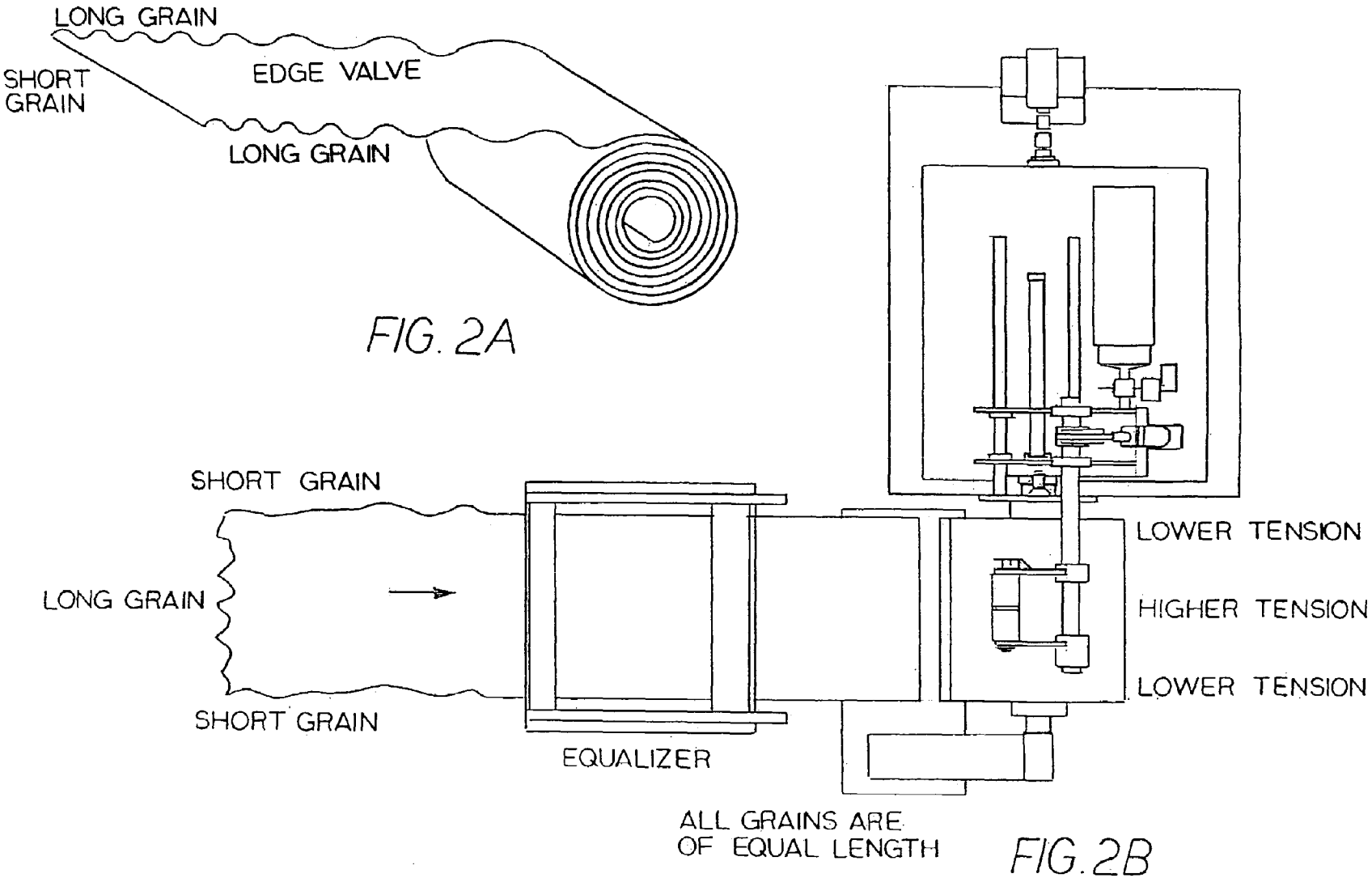
FIG. 2A is an isometric view of a metal strip that exhibits the edge wave condition wherein the grains on the edges are longer (thinner) than the grains in the center of the strip.
FIG. 2B is a top view that shows the operation of the equalizer station that addresses the edge wave condition.

One such physical shape defect is a condition known as edge waves. As shown in FIG. 2A, this condition is caused because the grains on the edges of the strip are longer (thinner) than the grains on the center of the strip (thicker). As the material is wound about the precision drum, the built-up of the layers causes the tension on the thicker part of the strip to be higher than the tension on the thinner part. Assisted by the reverse bending rolls, the tension is greater than what the entire cross section of the strip can withstand, the thicker part of the cross section, as it tries to travel at a higher peripheral speed than the thinner part, is first elongated and then the elongation extends toward the edges of the strip, until the total cross section of the strip is elongated.

The amount of elongation is controlled by the roller assembly of the equalizer station. In operation, there are two speed measuring devices, one located in front (i.e., upstream) of the bending rolls and one located immediately after (i.e., downstream) of the bending rolls. When these speed measuring devices sense a difference in the speed of the strip, a signal is sent to the system computer (50) so as to control the precision mandrel whereby the shape defects are corrected by applying more tension in one area of the strip, i.e., in the center of the strip, than others. Although the operation of the mandrel will be described in more detail hereinafter, very briefly, the mandrel can selectively expand its diametrical dimension so as to exert an additional tension on the region or area of the strip that exhibits the shorter grains whereby the result is that all of the grains are of equal length which means that the strip is flat.

Figures 3A, 3B, 3C:
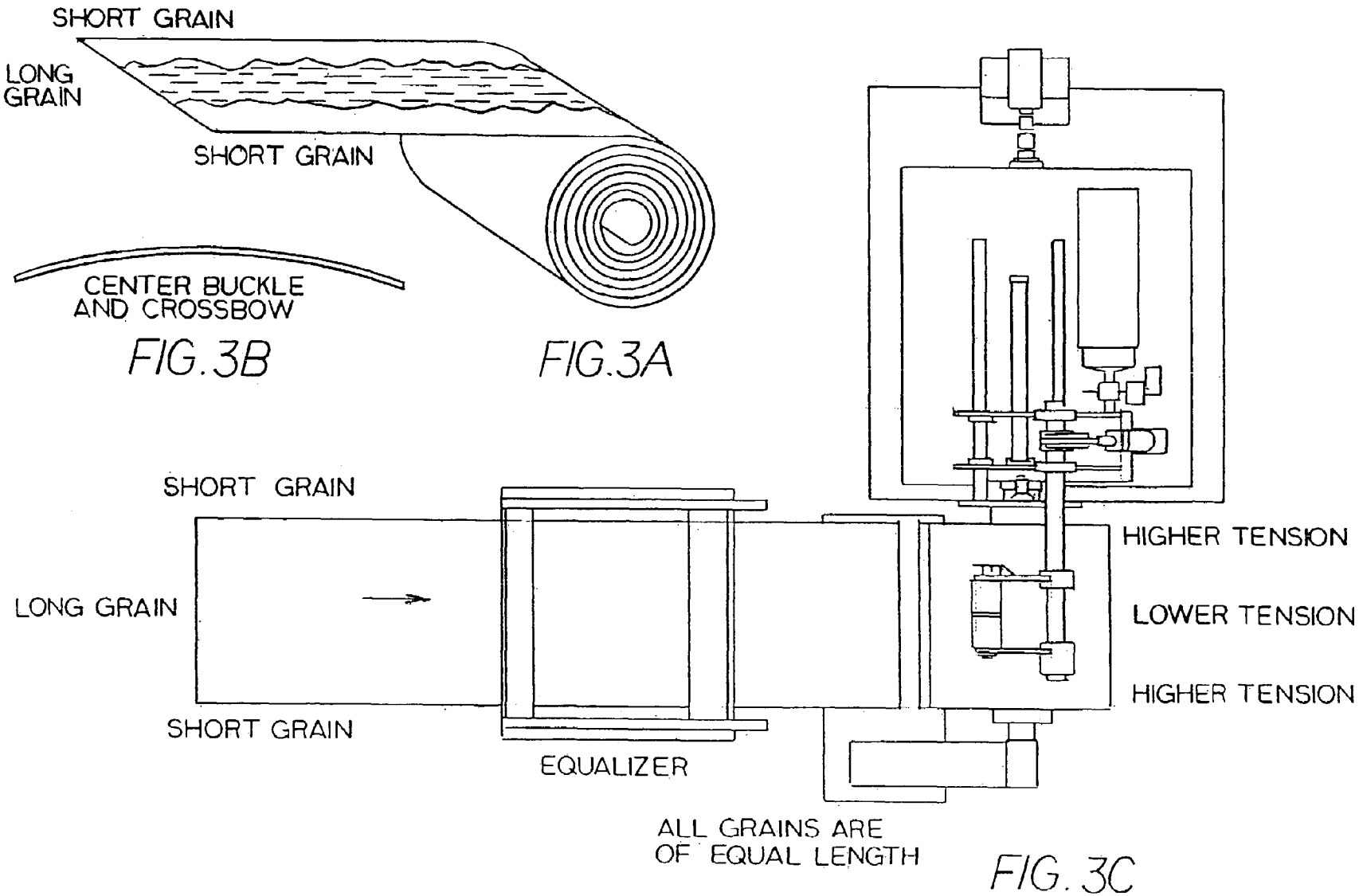
FIG. 3A is an isometric view that illustrates a metal strip that exhibits the center buckle (or oil can or cross bow) condition wherein the grains in the middle part of the strip are longer (thinner) than the grains on the edges of the strip.
FIG. 3B is an end view of the metal strip that exhibits the condition of center buckle (or oil can or cross bow) condition.
FIG. 3C is a top view that shows the equalizer station that addresses the center buckle (or oil can or cross bow) condition.

Another such physical shape defect is known as center buckles, or oil can or cross bow. FIG. 3A is an isometric view that shows these defects, which are caused because the grains on the middle part of the strip are longer (thinner) than the grains on the edges of the strip (thicker). As the material is wound about the precision drum, the built-up of the layers causes the tension on the thicker part of the strip to be higher than the tension on the thinner part. Assisted by the reverse bending rolls, the tension is greater than what the entire cross section of the strip can withstand, the thicker part of the cross section, as it tries to travel at a higher peripheral speed than the thinner part, is first elongated and then the elongation extends, beginning at the edges of the strip and then moving toward the center of the strip, until the total cross section of the strip is elongated.

As described above, the amount of elongation is controlled by the roller assembly of the equalizer station. If the two speed measuring devices sense a difference in the speed of the strip, a signal is sent to the system computer so as to control a precision mandrel whereby the shape defects are corrected by applying more tension in the area of the edges than others. Although the operation of the mandrel will be described in more detail hereinafter, very briefly, the mandrel can selectively expand its diametrical dimension so as to exert an additional tension on the region or area of the strip that exhibits the shorter grains whereby the result is that all of the grains are of equal length which means that the strip is flat.

Figure 4A:
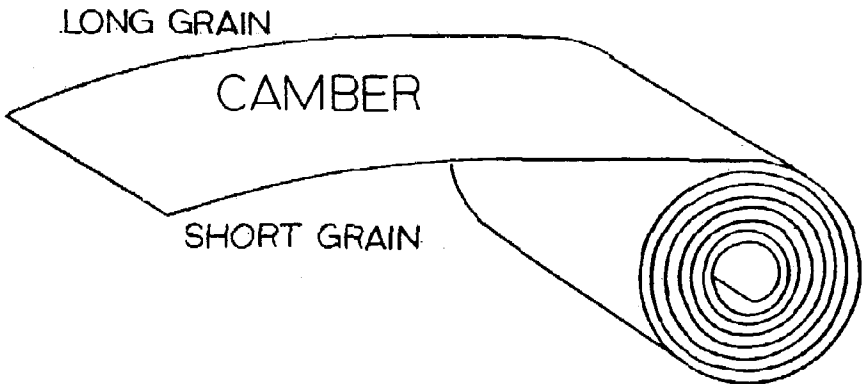
FIG. 4A is an isometric view that illustrates a metal strip that exhibits the camber condition wherein the grains on one edge of the strip are longer (thinner) than the grains in the opposite edge of the strip.
Figure 4B:
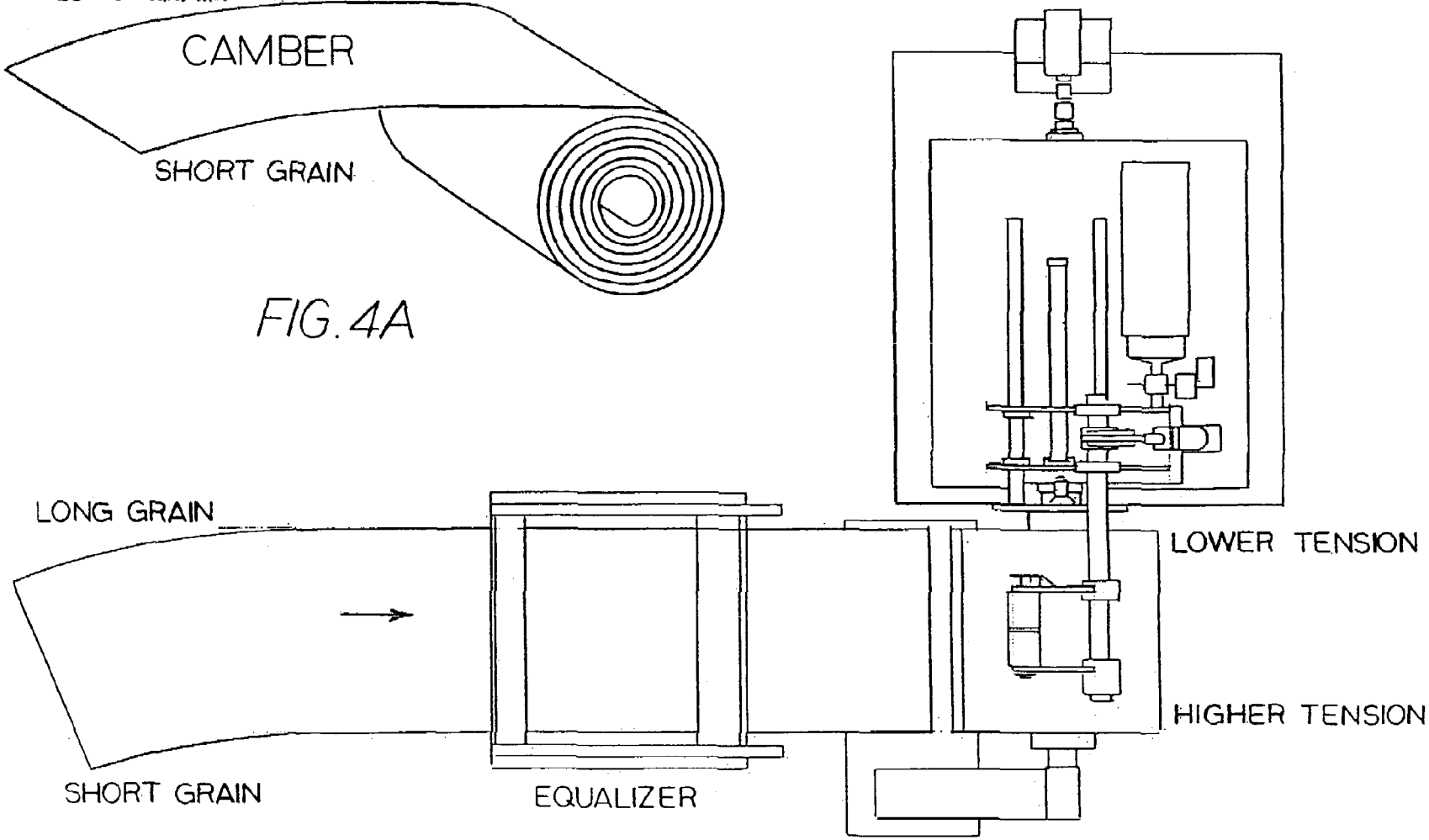
FIG. 4B is a view that shows the equalizer station that addresses the camber condition.

Another such physical shape defect is known as camber. Illustrated in the isometric drawing FIG. 4A, this is caused because the grains of one edge of the strip is longer (thinner) than the grains of the opposite edge of the strip. The edge of the strip where the grains are shorter (thicker), as the material is would about the precision drum, the built-up of the layers causes the tension on the side of the shorter grains of the strip to be higher than the tension on the longer edge of the strip. Assisted by the reverse bending rolls, the shorter (thicker) edge of the strip is elongated first. Then the elongation of the strip, progressively move from the thicker to the thinner edge of the strip until the entire cross section of the strip is elongated. Although the operation of the mandrel will be described in more detail hereinafter, very briefly, the mandrel can selectively expand its diametrical dimension so as to exert an additional tension on the region or area of the strip that exhibits the shorter grains whereby the result is that all of the grains are of equal length which means that the strip is flat.

Figure 9:
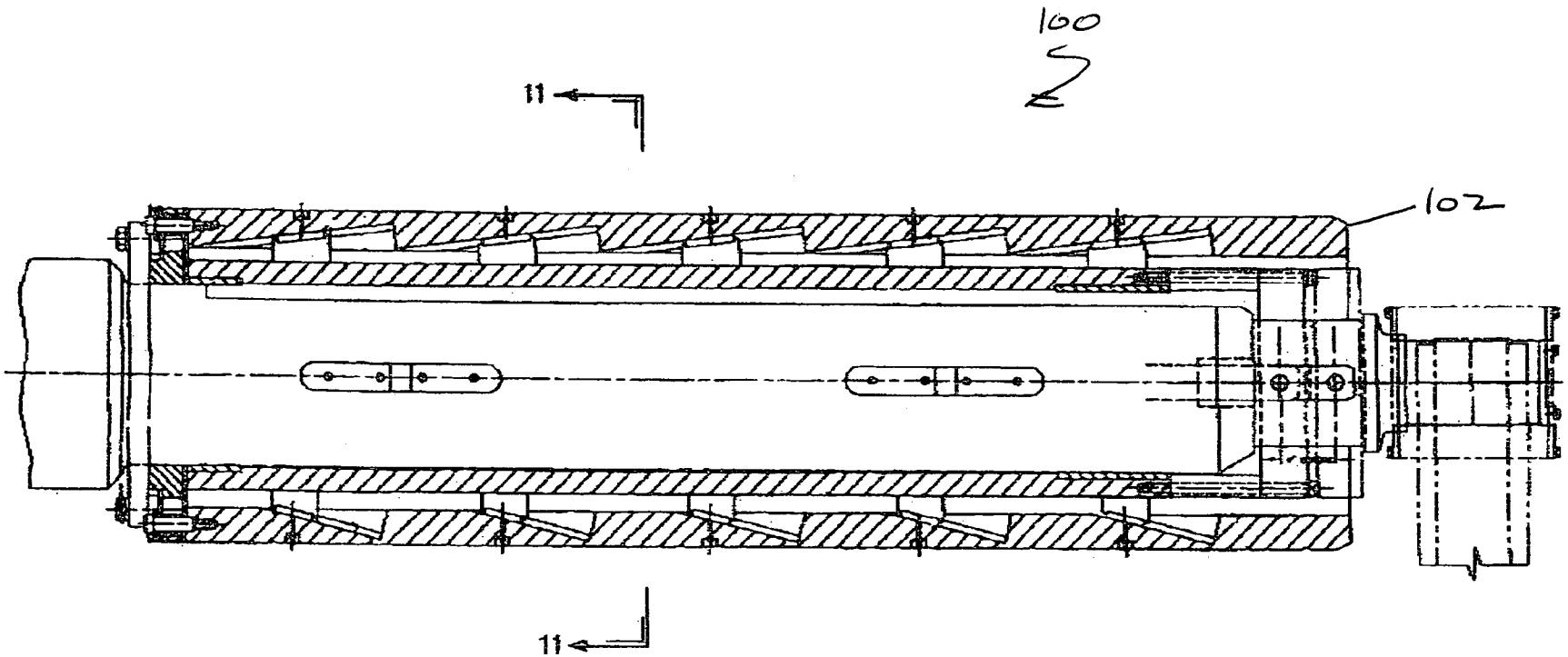
FIG. 9 is a longitudinal cross-sectional view of the mandrel of the equalizer station of the fist specific embodiment of the invention.
Figure 10:
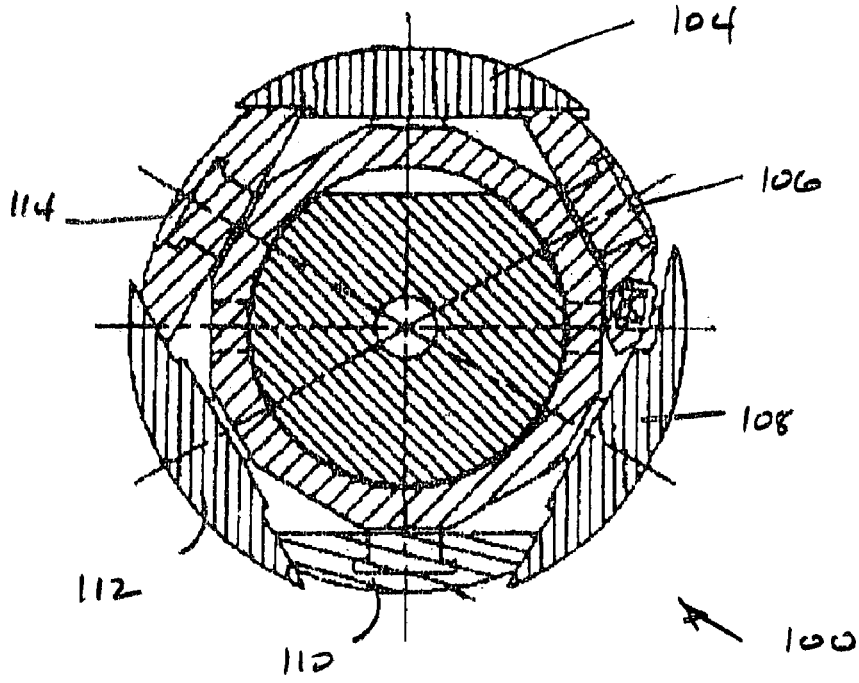
FIG. 10 is transverse cross-sectional view of the mandrel of FIG. 9 showing the mandrel in a contracted condition.
Figure 11:
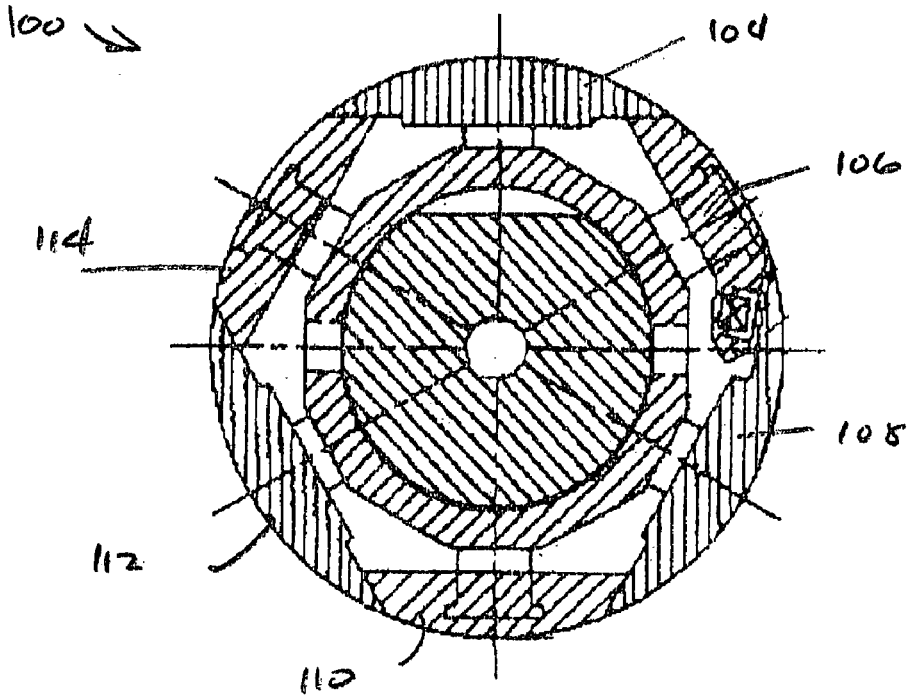
FIG. 11 is transverse cross-sectional view of the mandrel of FIG. 9 showing the mandrel in an expanded condition.

Referring to the mandrel 100 and in particular to FIGS. 9–11, the mandrell comprises an elongate body 102. There are six segments (104, 106, 108, 110, 112, 114) that are tungsten carbide coated elements. These segments are operated by a series of corresponding wedges as best shown in FIG. 9. Depending upon the condition of the strip as indicated by the speed monitors, the mandrel 100 can be in a contracted condition in which the diametrical dimension of the mandrel is at a minimum (see FIG. 10). When in the contracted condition, the mandrel does not exert a tension force upon the strip. Depending upon the condition of the strip as indicated by the speed monitors, the mandrel 100 can be in an expanded condition in which the diametrical dimension of the mandrel is at a maximum (see FIG. 11). When in the expanded condition, the mandrel exerts a tension force upon the strip whereby the result is an equalization of the grains across the width of the strip.

Figure 5B:
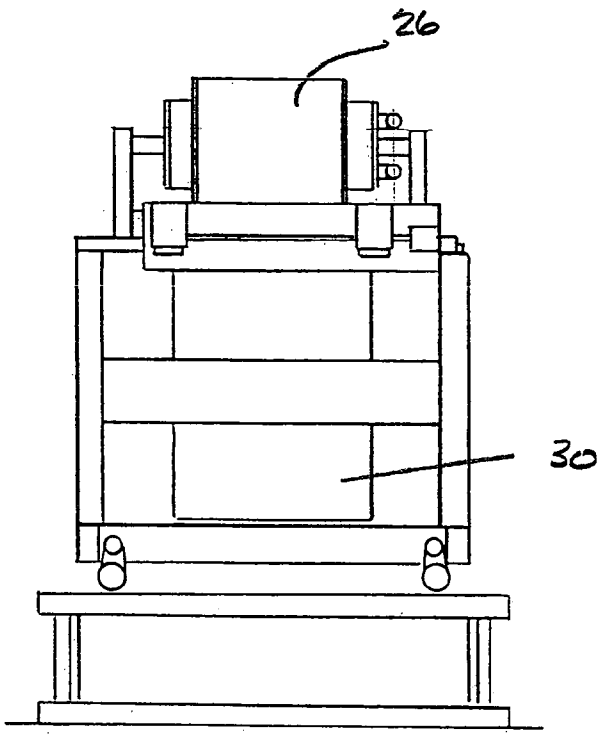
FIG. 5B is a rear view of the casting station of the apparatus.
Figure 5A:
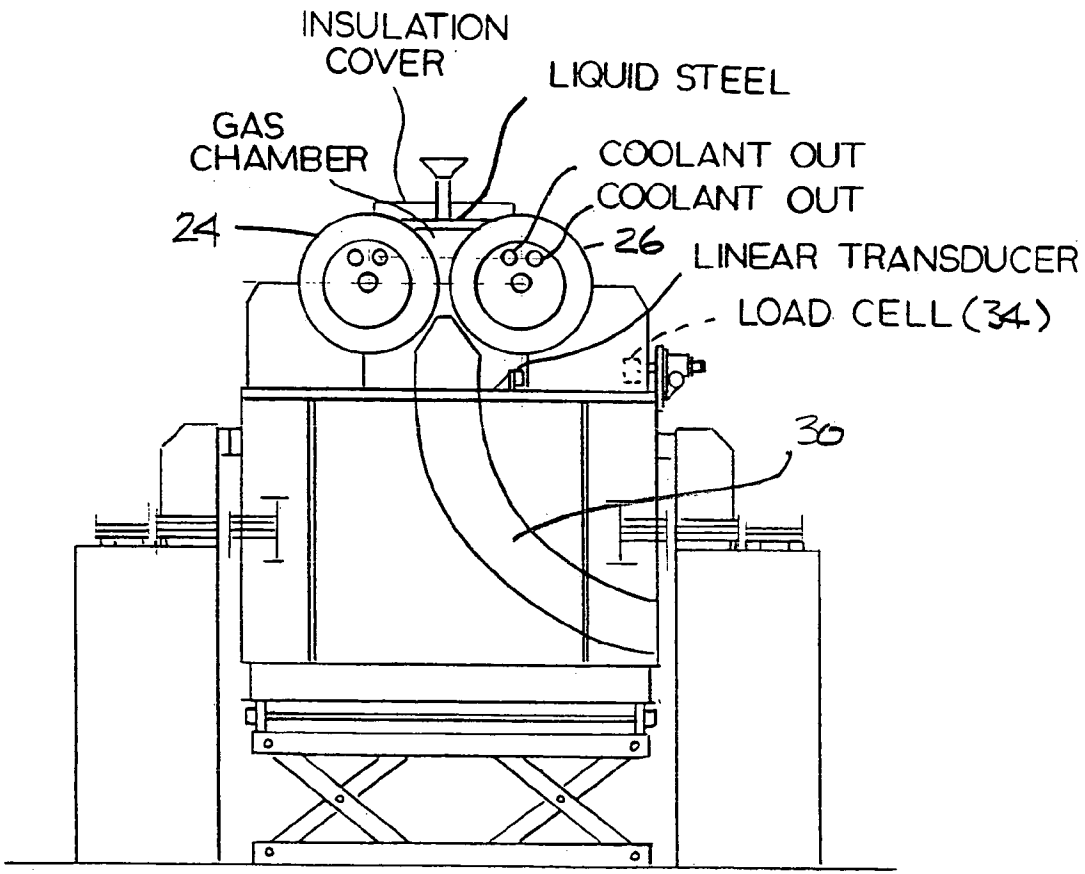
FIG. 5A is a side view of the casting station of the apparatus.

As mentioned hereinbefore, there are two speed monitoring devices. These speed monitoring devices provide a signal which is responsive to and indicative of the speed of the strip across the strip. This signal goes to a motor that drives a set of back tension rolls. This signal provides a TRIM There is a roll caster station as shown in FIG. 5. Referring now to FIG. 5B, the unique features of the roll caster station are illustrated. Computer aided simulations have been performed incorporating heat transfer analysis and calculations to provide the initial values for the following parameters: (1) the separation forces between the two layers of the solidified strip that are fused together, and (2) the temperature gradient between the cooling water at the intake and outlet of the casting rolls. The calculated initial values are then adjusted using the empirical data that is accumulated in actual operation.

The position of the casting rolls are not changed during operation. The distance of separation, that determines the thickness of the strip that is being produced is obtained by two (2) anti-backlash jactuators that are driven by means of a high torque hydraulic motor. The actual position of the roll is then registered by a linear transducer which via a proportional valve positions the movable roll to the precise distance of separation from the stationary roll.

Two load cells located at the base of the anti backlash jactuators, precisely monitor the actual separation force and compares it against the calculated value of the separation force, then the speed of the casting rolls is adjusted up or down, depending on the registered force of the separation between the two rolls. This speed trim, as a function of the separation forces, is complimented by a second speed trim that is provided by the actual temperature gradient of the incoming versus the outgoing cooling water.

FIG. 6B displays the cooling water flow across the roll and displays the control diagram which are provided in order to monitor and control the temperature gradient during the casting process.

Figure 7A:
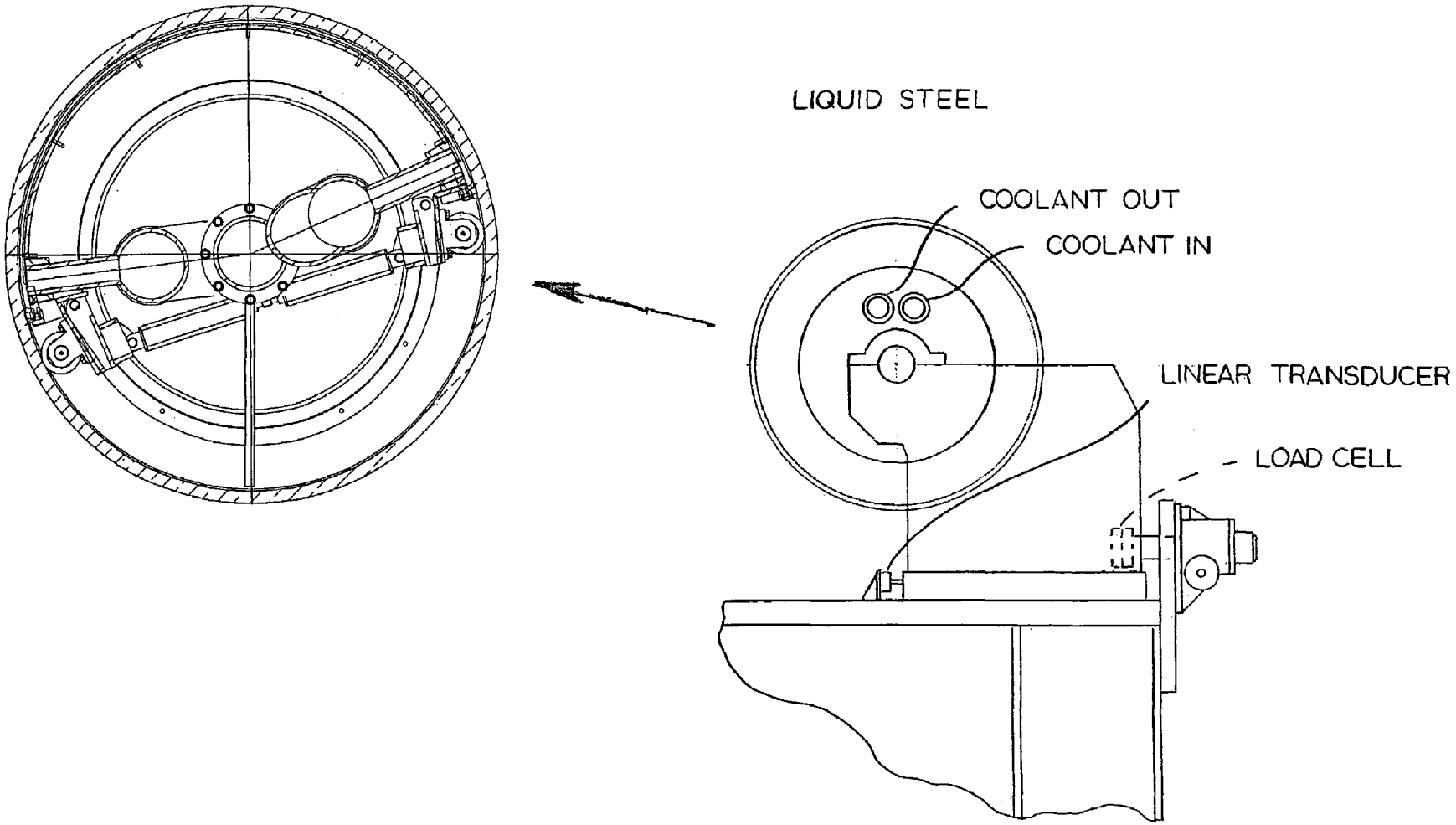
FIG. 7A is a schematic view of the casting station that includes a linear transducer and load cell and casting roll and an enlarged cross-sectional view of the casting roll wherein the cross-section is of the casting roll in FIG. 6A.
Figure 7B:
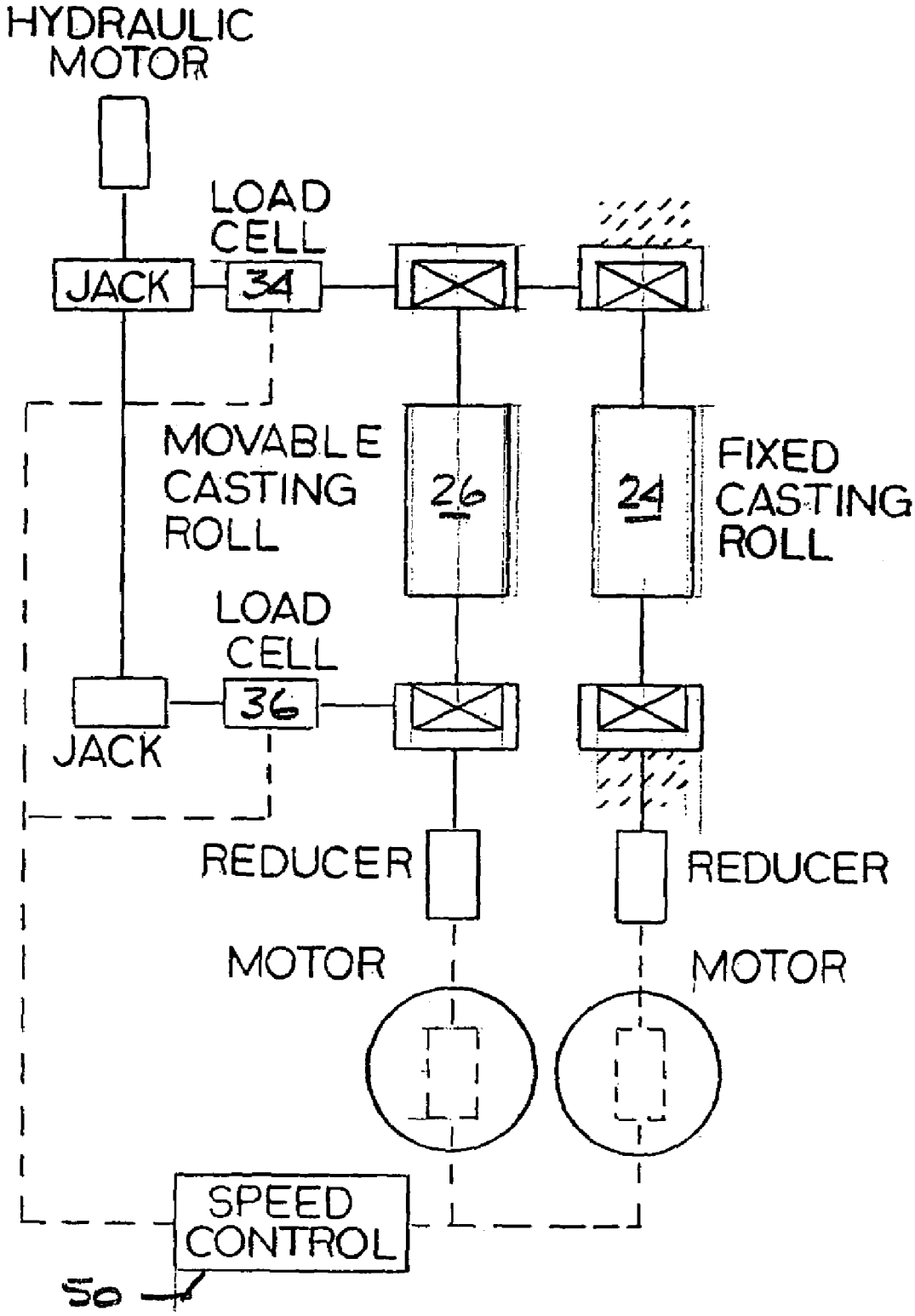
FIG. 7B is a schematic view showing the controlling of the relative positioning of the rolls with respect to each other in the casting station.
Figure 8:
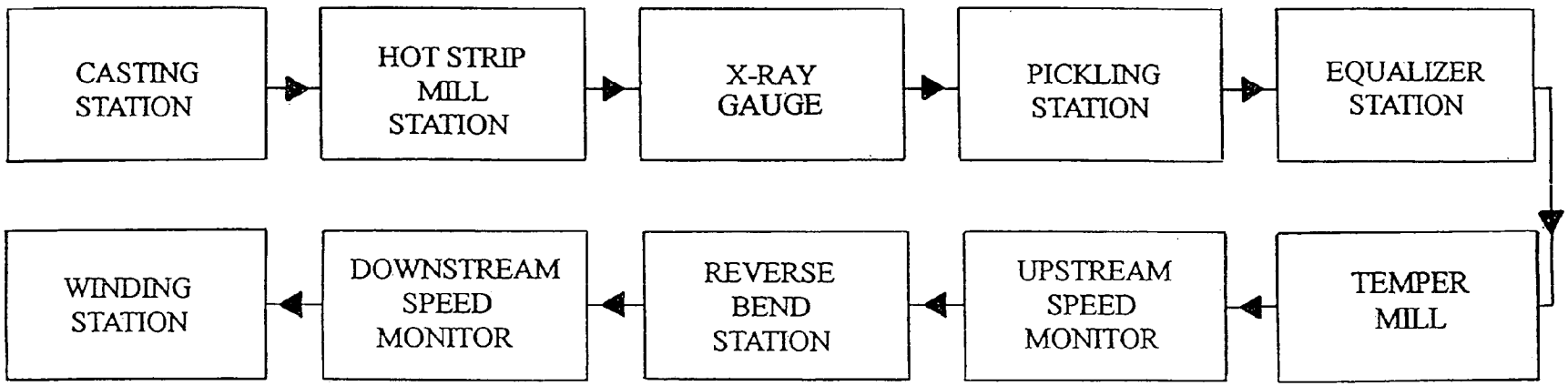
FIG. 8 is a schematic view that illustrates the steps that comprises the complete hot rolling casting process.

FIG. 7 displays the location of the load cells and the closed loop control that is used to trim the speed as a function of the separation force during the casting process.

In operation, one possible use for this process is to produce a substrate for Galvanizing line. Normally the substrate used to produce construction grade galvanized steel is full hard cold rolled steel, the furnace must anneal the full hard material and in order to do this, the strip has to be heated to 1472° F. (800° C.) and then cooled to the galvanizing temperature, which is 860° F. (460° C.). If the substrate is the product of the present invention, then the furnace does not have to anneal the steel and this creates an advantageous situation for the customers. In one aspect, since the product does not require annealing, the production speed does not have to be reduced as the thickness of the material increases. An increase in production (as much as 300%) is obtained with a reduction in energy consumption.

The patents, patent applications, and other documents identified herein are hereby incorporated by reference herein.

Other embodiments of the invention will be apparent to those skilled in the art from a consideration of the specification of the practice of the invention disclosed herein. It is intended that the specification and examples be considered as illustrative only, and that the true spirit and scope of the invention being indicated by the following claims.

What is claimed is:

1. A method of continuously elongating the grains of a metal strip, the method comprising the steps of:

providing a deflection-free mandrel driven by a motor for receiving the metal strip;

providing a reverse bending roll station that engages the metal strip upstream of the mandrel;

providing an equalizer roll assembly upstream of the reverse bending roll station;

providing an upstream roll to monitor the strip speed, the upstream roll being located upstream of the reverse bending roll station and downstream of the equalizer roll assembly whereby the upstream strip speed monitor monitors the speed of the strip as it enters the reverse bending station;

providing a downstream strip speed monitor located downstream of the reverse bend station whereby the downstream strip speed monitor monitors the speed of the strip as it exits the reverse bending station; and controlling the tension exerted on the metal strip as a function of the difference between the speed of the strip entering the reverse bending station and the speed of the strip exiting the reverse bending station.

2. An apparatus for continuously treating a moving metal strip, the apparatus comprising:

a mandrel driven by a motor whereby the mandrel receives the metal strip in a coil;

a reverse bending roll station positioned upstream of the mandrel whereby the reverse bending station engages the metal strip;

an equalizer roll assembly located upstream of the reverse bending roll station;

an upstream strip speed monitor located upstream of the reverse bending roll station and downstream of the equalizer roll assembly so as to monitor the speed of the strip as it enters the reverse bending station;

a downstream strip speed monitor located downstream of the reverse bend station so as to monitor the speed of the strip as it exits the reverse bending station; and a controller operatively connected to the mandrel so as to control the tension exerted on the strip by the tension roll and to transfer current to the motor as a function of the difference between the speed of the strip entering the reverse bending station and the speed of the strip exiting the reverse bending station.

3. The method of claim 1 wherein the mandrel having a generally cylindrical surface so as to define a diameter, and controlling of the tension exerted on the metal strip is performed by the mandrel wherein the diameter of the mandrel increases or decreases in response to the difference between the speed of the strip entering the reverse bending station and the speed of the strip exiting the reverse bending station.

4. The apparatus of claim 2 wherein the mandrel defines a generally cylindrical peripheral surface and the mandrel having a transverse dimension; the mandrel being movable between and including a contracted position wherein the mandrel presents a minimum transverse dimension so as to exert a minimum tension on the strip and an expanded position wherein the mandrel presents a maximum dimension so as to exert a maximum tension upon the strip; and a controller operatively connected to the mandrel so as to move the mandrel to a position between and including the contracted position and expanded position so as to exert a selected tension on the moving strip.

5. The apparatus of claim 4 wherein the mandrel includes a segment that has an exterior surface that defines at least a portion of the cylindrical peripheral surface of the mandrel, and the segment being movable between and including a contracted position wherein the mandrel presents the minimum transverse dimension and an expanded position wherein the mandrel presents the maximum dimension.

6. The apparatus of claim 4 wherein the mandrel includes a plurality of the segments.

* * * * *